US005609116A

United States Patent [19]

Koike

[11] Patent Number: 5,609,116

[45] Date of Patent: Mar. 11, 1997

[54] SEWING MACHINE INCLUDING CLOTH PRESSER LEVER LIFTING

[75] Inventor: Huji Koike, Nagoya, Japan

[73] Assignee: Royal Industries Co., Ltd., Aichi, Japan

[21] Appl. No.: 632,353

[22] Filed: Apr. 10, 1996

[30] Foreign Application Priority Data

Aug. 10, 1995 [JP] Japan ..... 7-227035

[51] Int. Cl.[6] ..... D05B 29/02

[52] U.S. Cl. ..... 112/169; 112/237

[58] Field of Search ..... 112/169, 237, 112/238, 11, 60, 61, 235, 236, 240

[56] References Cited

U.S. PATENT DOCUMENTS

| | | | |
|---|---|---|---|
| 2,176,977 | 10/1939 | Nicolay | 112/169 |
| 3,957,004 | 5/1976 | Ketterer et al. | 112/169 |
| 4,505,213 | 3/1985 | Killinger | 112/169 X |

FOREIGN PATENT DOCUMENTS

| | | | |
|---|---|---|---|
| 2053778 | 4/1971 | France | 112/169 |
| 2112825 | 7/1983 | United Kingdom | 112/169 |

*Primary Examiner*—Ismael Izaguirre
*Attorney, Agent, or Firm*—Koda and Androlia

[57] ABSTRACT

A miniature handy electric sewing machine includes a casing including a grip portion, a sewing table projecting from one end of the casing, a sewing head pivotally mounted on a rear end of the sewing table and including a sewing needle fastened to its front end, and a cloth presser lever having at its front end a pressing portion which is pressed against an upper surface of the sewing table by a spring force. The cloth presser lever is pivotally mounted on the rear end of the sewing table together with the sewing table. The sewing machine further includes an oscillation mechanism for vertically oscillating the sewing head and a feed mechanism operatively connected to the oscillation mechanism for feeding an object to be sewed by predetermined pitches, the object being held between the sewing table and the pressing portion of the cloth presser lever. An operation lever is mounted at one side of the grip portion for pushing the cloth presser lever against the spring force, permitting the pressing portion of the cloth presser lever to depart above the sewing table. The operation lever may be pivotally mounted on a shaft further mounted on the casing.

4 Claims, 4 Drawing Sheets

SEWING MACHINE INCLUDING CLOTH PRESSER LEVER LIFTING

BACKGROUND OF THE INVENTION

1. Field of the Invention

The present invention relates to a handy automatic sewing machine operated one-handed.

2. Description of the Prior Art

The prior art has proposed a handy automatic sewing machine comprising a casing serving as a grip portion. A sewing table projects from one end of the casing. A sewing head is pivotally mounted on a rear end of the sewing table and including a sewing needle fastened to a front end thereof. A cloth presser lever has at a front end thereof a pressing portion which is pressed against an upper surface of the sewing table by a spring force. The cloth presser lever is pivotally mounted on the rear end of the sewing table together with the sewing head. An oscillation mechanism is provided for vertically oscillating the sewing head. A feed mechanism is provided on the underside of the front end of the sewing table to be operatively connected to the oscillation mechanism for feeding an object to be sewed by predetermined pitches, which object being held between the sewing table and the pressing portion of the cloth presser lever.

In the above-described sewing machine, however, a user grips the grip portion of the sewing machine in one hand to hold the same. The user pushes the cloth presser lever with the other hand against a spring force to thereby hold the same. Simultaneously, the object to be sewed is set at a sewing position on the sewing table or detached therefrom. Accordingly, the sewing machine held in said one hand of the user is unstable, and the sewed object cannot be easily set on the sewing table. Thus, the usability of the prior art handy automatic sewing machine is low.

SUMMARY OF THE INVENTION

Therefore, an object of the present invention is to provide a handy automatic sewing machine wherein the usability thereof can be improved by provision of an operation lever pushing up the cloth presser lever.

Another object of the present invention is to provide a handy automatic sewing machine wherein the operation lever pushing up the cloth presser lever can be prevented from falling off.

Further another object of the present invention is to provide a handy automatic sewing machine wherein the operation lever can be easily operated by pivotally mounting the same on a support shaft.

The present invention provides a handy automatic sewing machine comprising a casing including a grip portion, a sewing table projecting from one end of the casing, a sewing head pivotally mounted on a rear end of the sewing table and including a sewing needle fastened to a front end thereof, a cloth presser lever having at a front end thereof a pressing portion which is pressed against an upper surface of the sewing table by a spring force, the cloth presser lever being pivotally mounted on the rear end of the sewing table together with the sewing table, an oscillation mechanism for vertically oscillating the sewing head, a feed mechanism provided on the underside of the front end of the sewing table to be operatively connected to the oscillation mechanism for feeding an object to be sewed by predetermined pitches, the object being held between the sewing table and the pressing portion of the cloth presser lever, and an operation lever provided in the vicinity of the grip portion for pushing the cloth presser lever against the spring force, thereby permitting the pressing portion of the cloth presser lever to depart above the sewing table.

According to the above-described construction, the operation lever is operated such that the cloth presser lever is pushed up. The operation lever can be operated with a finger of one hand in which the user grips the grip portion of the sewing machine since the operation lever is disposed in the vicinity of the grip portion of the casing. Consequently, the sewing machine can be reliably held in one hand of the user. Furthermore, the user can devote his or her other hand to setting the object to be sewed at the sewing position on the sewing table. Consequently, since the operability of the sewing machine is thus improved, usability thereof can be improved.

In a preferred form of the present invention, the operation lever includes a push-operation portion and a pushing face having an engagement groove in a front edge thereof and the sewing head includes a lever actuating member engaged with the engagement groove of the pushing face of the operation lever. Consequently, the operation lever can be prevented from falling off the sewing table.

In another preferred form of the present invention, the casing includes a support shaft and the operation lever is pivotally mounted on a support shaft further mounted on the casing. Consequently, the cloth presser lever can be pushed up by application of an optimum operating force readily and reliably by adjustment of the positional relation between points of application of force.

BRIEF DESCRIPTION OF THE DRAWINGS

Other objects, features and advantages of the present invention will become clear upon reviewing the following description of preferred embodiments thereof, made with reference to the accompanying-drawings, in which.

DETAILED DESCRIPTION OF THE PREFERRED EMBODIMENTS

Figure 1:
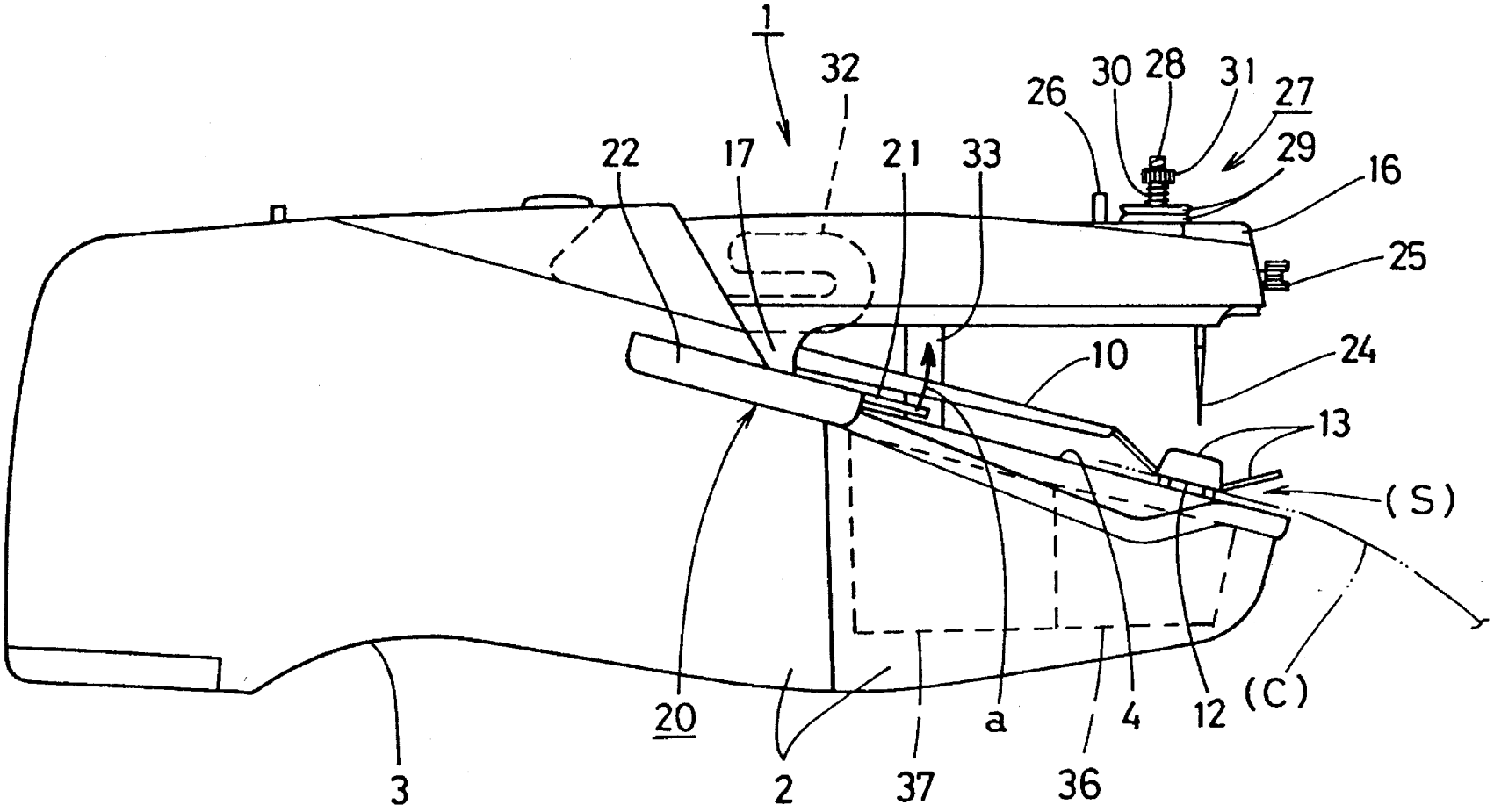
FIG. 1 is a front view of a handy automatic sewing machine of an embodiment in accordance with the present invention.
Figure 2:
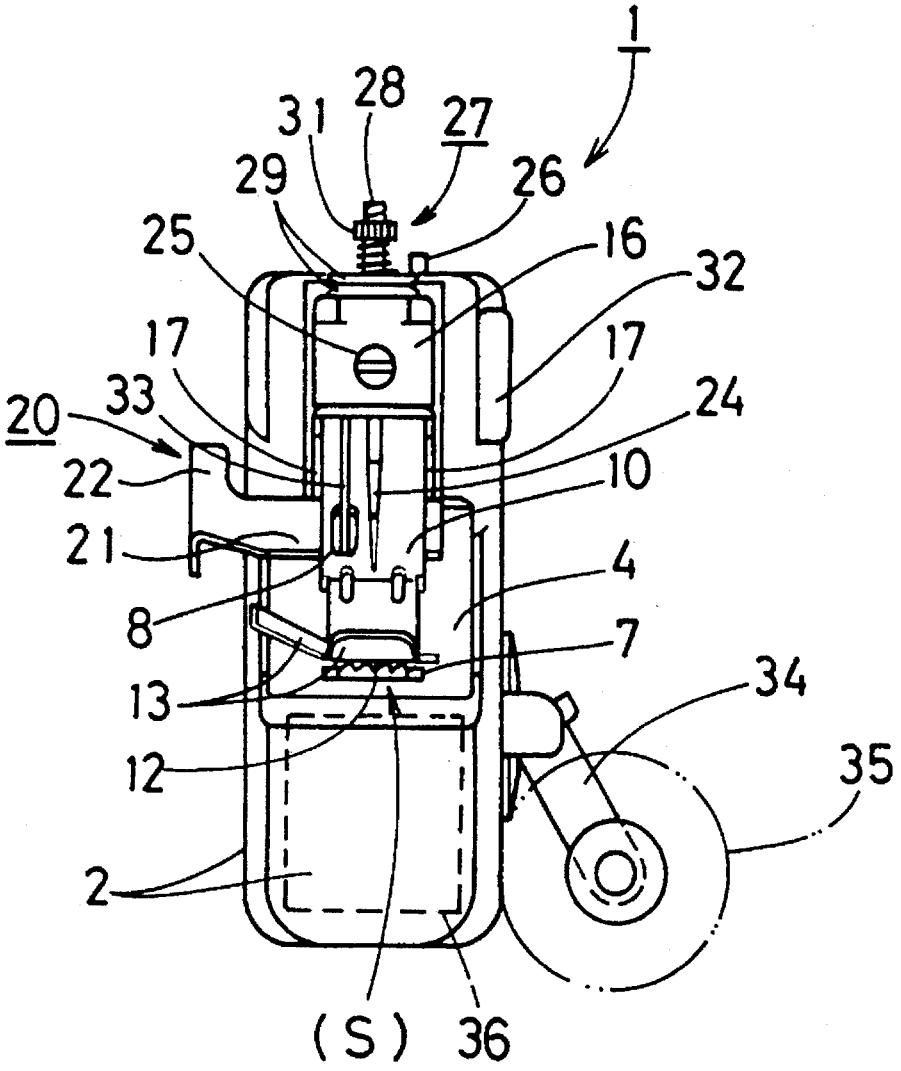
FIG. 2 is a side view of the sewing machine.
Figure 3:
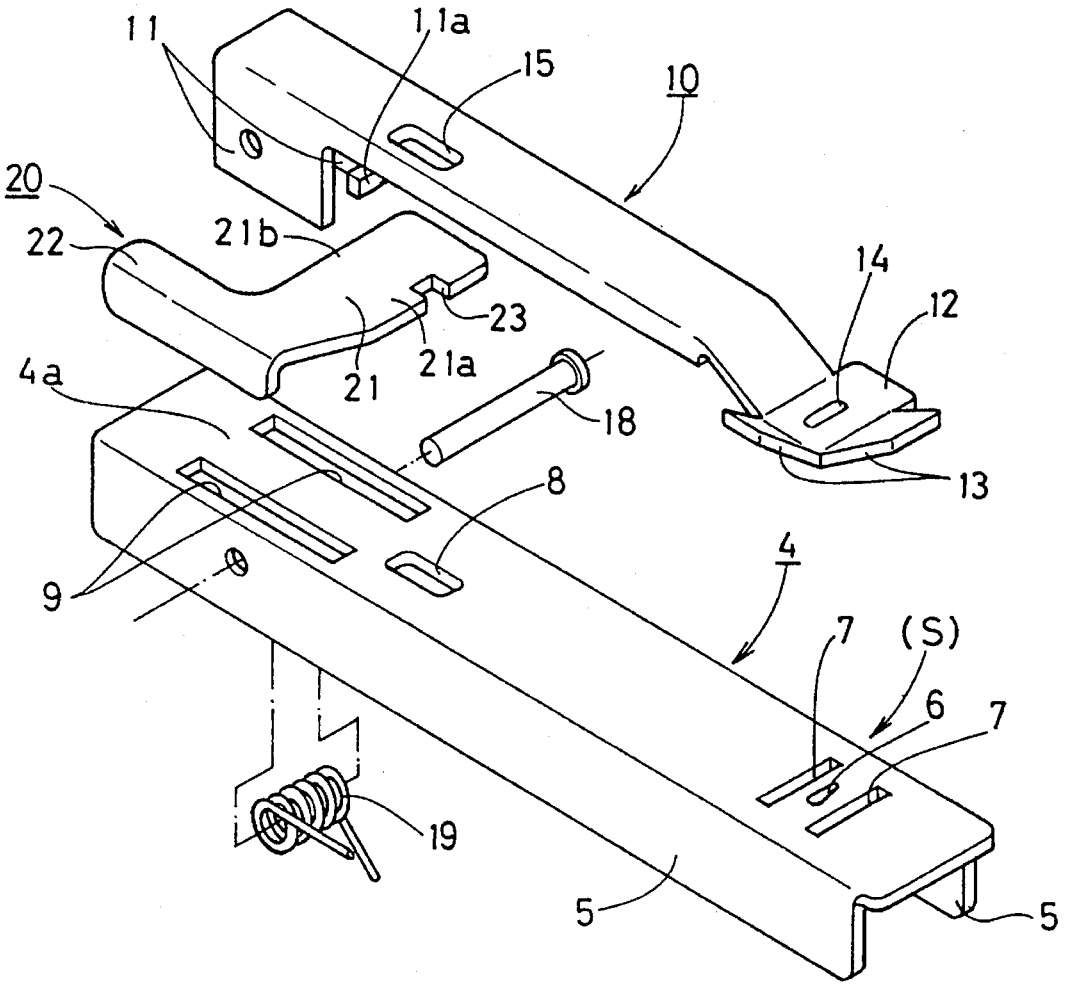
FIG. 3 is an exploded perspective view of a sewing table, cloth presser lever, and operation lever of the sewing machine.

An embodiment of the present invention will be described with reference to FIGS. 1 to 3. Referring to FIG. 1, a handy automatic sewing machine 1 of the embodiment is shown. A casing 2 is formed on its outer periphery a grip portion 3 which can be gripped with one hand of a user to be held. A sewing table 4 is fixed to one end of the casing 2 to be disposed to be obliquely inclined such that its front end is located lower. The sewing table 4 includes side plates 5 bent lengthwise at both sides thereof and having respective through holes, as is shown in FIG. 3. The sewing table 4 has a needle hole 6 formed therethrough at a sewing position S of one end thereof and two elongated openings 7 extending at opposite sides of the hole 6 to be parallel to each other in the direction crossing approximately perpendicularly to the lengthwise direction of the sewing table 4. The sewing table 4 further has in the central portion thereof a longitudinally extending elongated opening 8. The sewing table 4 further has two elongated parallel openings 9 formed in the other end 4*a* thereof to extend longitudinally thereof. A cloth presser lever 10 has two shaft support strips 11 formed by bending both sides at the rear end thereof and having respective through holes. The shaft support strips 11 and other shaft support strips 17 of a sewing head 16 which will be described later are adapted to be fitted in the openings 9 respectively.

The cloth presser lever 10 has a pressing portion 12 and a guide strip 13 both formed by bending the front end thereof, as is shown in FIG. 3. The pressing portion 12 has a through hole 14 formed to correspond to the needle hole 6. The cloth presser lever 10 further has a centrally formed elongated opening 15 corresponding to the opening 8 of the sewing table 4. The sewing head 16 is disposed on the upper surface of the cloth presser lever 10, and the shaft support pieces 17 formed by bending the central sides thereof and having respective through holes (not shown) are disposed outside the shaft support strips 11 of the cloth presser lever 10 such that the shaft support strips 11 and 17 are juxtaposed. The-juxtaposed shaft support strips 11 and 17 are fitted in the openings 9 respectively. A shaft 18 is then inserted through the holes of the side plates 5 of the sewing table 4, shaft support strips 17 and 11 so as to extend between both side plates 5.

A return spring 19 encompasses the shaft 18 between the side plates 5 of the sewing table 4. Both ends of the return spring 19 are engaged with the inside surface of the sewing table 4 and la hook 11*a* formed on the underside of the cloth presser lever 10 respectively so that the pressing portion 12 of the cloth presser lever 10 is pressed on the sewing position S of the sewing table 4. An operation lever 20 is interposed between the sewing table 4 and the cloth presser lever 10 so as to be positioned forward of the shaft support strips 11 of the lever. The operation lever 20 includes a pushing face 21 pushing up the cloth presser lever 10 and a push-operation portion 22 extending rearwardly along one side of the casing 2. The pushing face 21 has a notch or an engagement groove 23 formed in the front edge thereof.

A needle 24 is inserted into a hole (not shown) formed in the underside of the front end of the sewing head 16 to be fixed in position by a clamp screw 25. A thread guide pin 26 and a thread tension adjuster 27 are provided on the upper face of the front end of the sewing head 16. The thread tension adjuster 27 comprises two dish-shaped discs 29 loosely fitted with a screw 28 secured to the upper face of the sewing head 16, a presser spring 30 encompassing the screw 28, and an adjusting nut 31 screwed onto the screw 28. The sewing head 16 further has a thread guide 32 centrally formed on one side face thereof and a lever actuating member 33 provided on the central underside thereof. The lever actuating member 33 extends through the opening 15 of the cloth presser lever 10 and the opening 8 of the sewing table 4 in turn, projecting below the latter. The lever actuating member 33 is further engaged with the engagement groove 23 of the operation lever 20 to thereby prevent the lever from falling off. A rocking bracket 34 is provided on the side face of the casing 2 on which the thread guide 32 is provided. A bobbin 35 on which a sewing thread (not shown) is wound is rotatably attached to the rocking bracket 34.

A feed mechanism 36 is provided under the sewing table 4 in the casing 2 for feeding an object C to be sewed by predetermined pitches. An oscillation mechanism 37 is incorporated in the casing 2 for vertically oscillating the sewing head 16 via the lever actuating member 33. The oscillation mechanism 37 is driven by a DC motor (not shown). The object C is held on the sewing position S between the sewing table 4 and the pressing portion 12 of the cloth presser lever 10. The feed mechanism 36 is operatively connected to the oscillation mechanism 37 to feed the object C in the above-described condition by the predetermined pitches in the direction crossing the sewing table 4 in association with the vertical oscillation of the sewing head 16.

The operation of the operation lever 20 of the above-described handy sewing machine 1 will be described. The push-operation portion 22 of the operation lever 20 is pushed downwardly with a thumb of a hand in which the user grips the grip portion 3, in the condition that the front end of the sewing head 16 remains at the upper position. The front edge 21*a* of the pushing face 21 of the operation lever 20 is then rotated counterclockwise as shown by arrow a in FIG. 1 with the rear edge 21*b* as a fulcrum, so that the cloth presser lever 10 is pushed upwardly against a force of the return spring 19. Since the cloth presser lever 10 is mounted on the shaft 18 at the rear end 4*a* of the sewing table 4, the pressing portion 12 of the cloth presser lever 10 is caused to depart above the sewing position S. The user sets the object to be sewed at the sewing position on the sewing table 4 with his or her other hand. Thereafter, when the operation lever 20 is released from the pushed condition, the return spring 19 causes the cloth presser lever 10 to return to the former position such that the object C is pressed onto the sewing position S by the pressing portion 12. The sewing head 16 is then oscillated so that sewing are carried out in sewing manners such as a chain stitch.

Figure 4:
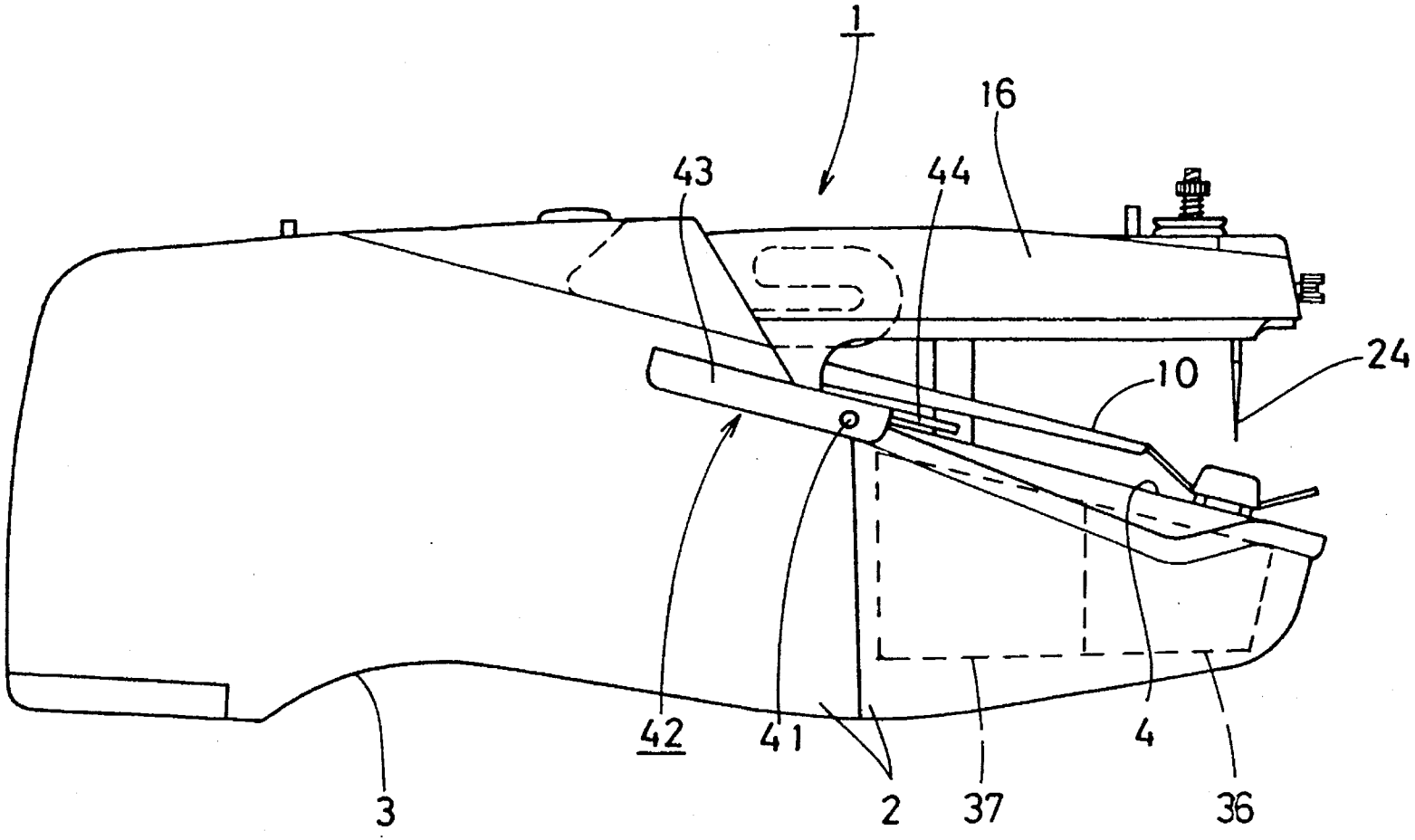
FIG. 4 is a front view of a handy automatic sewing machine of another embodiment in accordance with the present invention.

FIG. 4 illustrates the handy sewing machine of another embodiment in accordance with the present invention. A support shaft 41 is provided on one side of the casing 2. An operation lever 42 pushing the cloth presser lever 10 upwardly is rotatably mounted on the support shaft 41. Since the center of rotation of the operation lever 42 is fixed, the cloth presser lever 10 can be pushed upwardly readily and reliably when the positional relation between the points of application of force or between the push-operation portion 43 of the lever 42 and the front edge of a pushing face 44 is set for an optimum.

According to the above-described embodiments, the handy sewing machine can be reliably held in one hand of the user. Furthermore, the operation lever can be operated with one of the fingers of the hand in which the user grips the sewing machine, so that the cloth presser lever is pushed upwardly. Accordingly, since the other hand of the user can be devoted to setting the object to be sewed at the sewing position on the sewing table, the operability of the handy sewing machine can be improved. Consequently, the usability of the sewing machine can be improved.

Furthermore, since the operation lever is rotatably mounted on the support shaft, the cloth presser lever can be pushed upwardly readily and reliably when the positional relation between the points of application of force is set for the optimum. Consequently, the usability of the handy sewing machine can be further improved.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

What is claimed is:

1. A handy automatic sewing machine comprising:

a casing including a grip portion;

a sewing table projecting from one end of the casing;

a sewing head pivotally mounted on a rear end of the sewing table and including a sewing needle fastened to a front end thereof;

a cloth presser lever having at a front end thereof a pressing portion which is pressed against an upper surface of the sewing table by a spring force, the cloth presser lever being pivotally mounted on the rear end of the sewing table together with the sewing table;

an oscillation mechanism for vertically oscillating the sewing head;

a feed mechanism provided on the underside of the front end of the sewing table to be operatively connected to the oscillation mechanism for feeding an object to be sewed by predetermined pitches, the object being held between the sewing table and the pressing portion of the cloth presser lever; and an operation lever provided in the vicinity of the grip portion for pushing the cloth presser lever against the spring force, thereby permitting the pressing portion of the cloth presser lever to depart above the sewing table.

2. A handy automatic sewing machine according to claim 1, wherein the operation lever includes a push-operation portion and a pushing face having an engagement groove in a front edge thereof and the sewing head includes a lever actuating member engaged with the engagement groove of the pushing face of the operation lever.

3. A handy automatic sewing machine according to claim 1, wherein the casing includes a support shaft and the operation lever is pivotally mounted on a support shaft further mounted on the casing.

4. A handy automatic sewing machine according to claim 2, wherein the casing includes a support shaft and the operation lever is pivotally mounted on a support shaft further mounted on the casing.

* * * * *